US005551465A

United States Patent [19]

Steiner

[11] Patent Number: 5,551,465

[45] **Date of Patent: *Sep. 3, 1996**

[54] SUNSHADE

[76] Inventor: Walter Steiner, Saentisstrasse 52, CH-8311 Bruetten, Switzerland

[ * ] Notice: The term of this patent shall not extend beyond the expiration date of Pat. No. 5,398,710.

[21] Appl. No.: 349,829

[22] Filed: Dec. 6, 1994

Related U.S. Application Data

[62] Division of Ser. No. 963,055, Oct. 19, 1992, Pat. No. 5,398,710.

[51] Int. Cl.[6] ..... F04H 15/28; A45B 25/18

[52] U.S. Cl. ..... 135/98; 135/16; 135/20.3; 135/31; 135/33.2

[58] Field of Search ..... 135/98, 99, 16, 135/19.5, 20.3, 31, 33.2, 33.4, 33.41, 33.6, 33.7

[56] References Cited

U.S. PATENT DOCUMENTS

| | | | |
|---|---|---|---|
| 858,967 | 7/1907 | Dimond | 135/33.2 |
| 1,174,116 | 3/1916 | Berman | 135/19.5 |
| 2,213,058 | 8/1940 | Sweet et al. | 135/33.2 |
| 3,692,035 | 9/1972 | Houston | 135/33.2 |
| 3,885,582 | 5/1975 | Fowalski | 135/33.7 |
| 4,865,063 | 9/1989 | Williams | 135/33.7 |
| 5,305,770 | 4/1994 | DeMarco | 135/33.2 |

*Primary Examiner*—Michael Safavi
*Attorney, Agent, or Firm*—Ladas & Parry

[57] ABSTRACT

The sunshade has several carrying bars (1) which can be spread in radially directed manner away from a central headpiece and several screening surface structures (17), which are in each case fixed between two carrying bars (1). In order to prevent a sag of the surface structure (17) in the case of incomplete spreading of the sunshade and in order to permit an easy closure to give a compact shape, it is made from pleated awning material, which in the relaxed state and with the sunshade collapsed assumes a pointed, zig-zag cross-sectional shape. In addition, with spring pulls cords (35) extend between the carrying bars (1) in the circumferential direction of the sunshade. Stiff envelope surfaces (14, 15) provided on either side of the carrying bars (1) give a columnar shape to the compact, collapsed sunshade.

3 Claims, 6 Drawing Sheets

FIG. 1
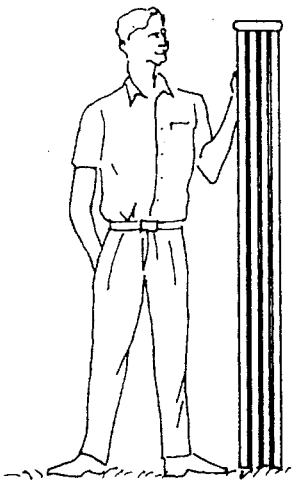
FIG. 2
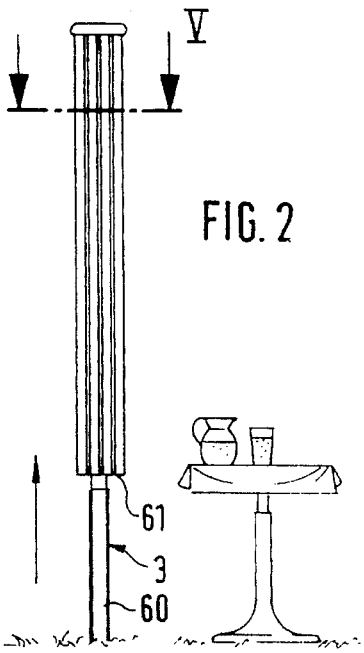
FIG. 3
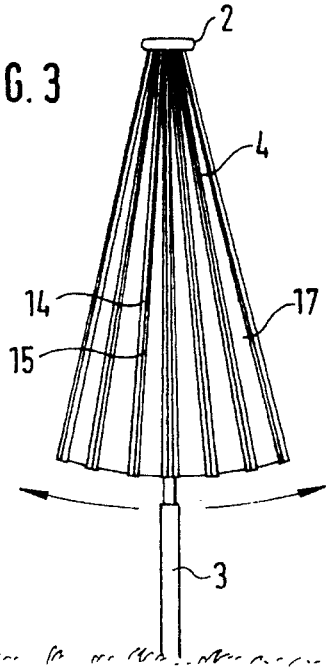
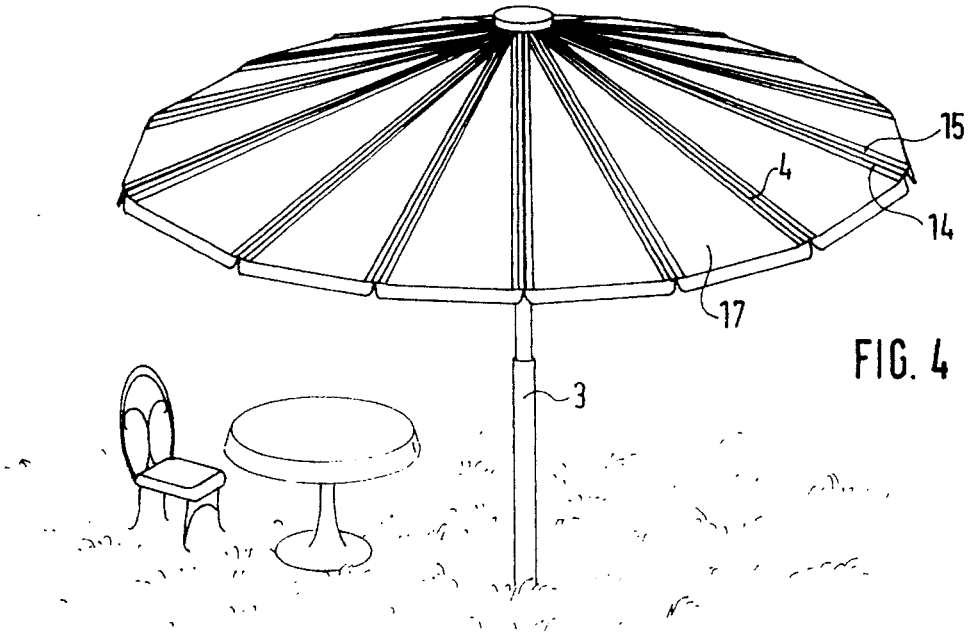
FIG. 4

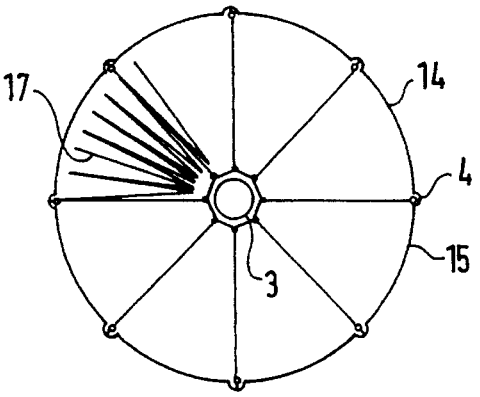
FIG. 5
FIG. 6
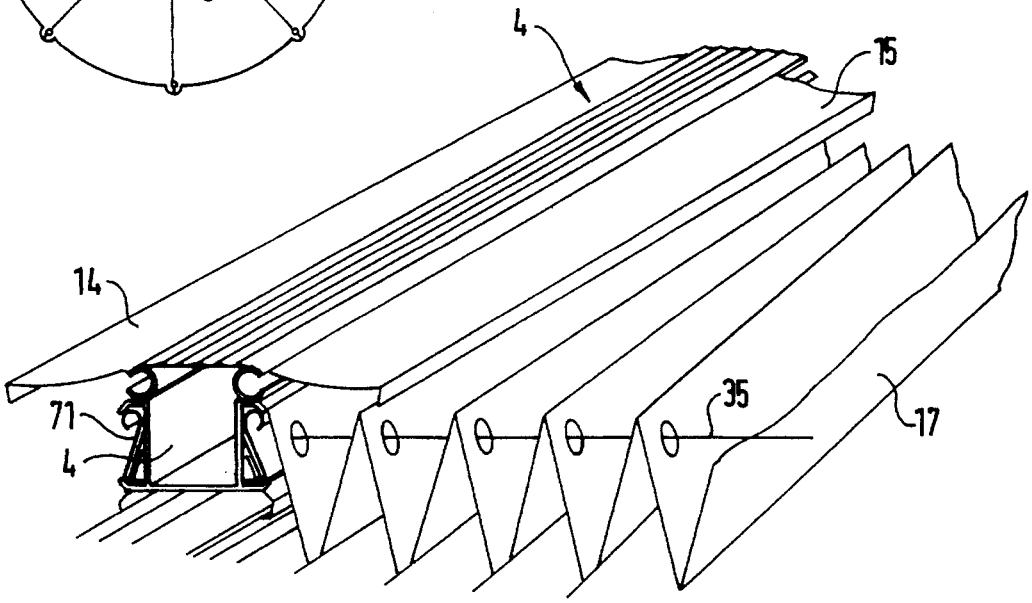
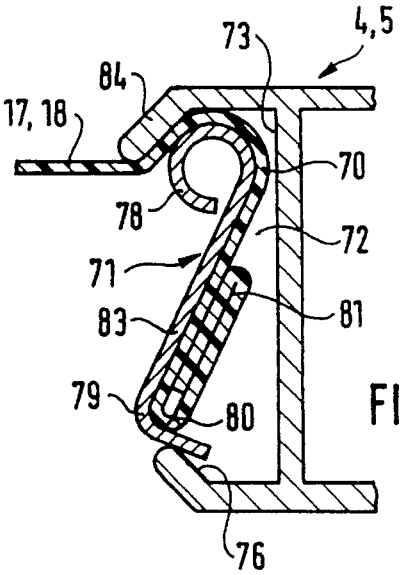
FIG. 7
FIG. 8
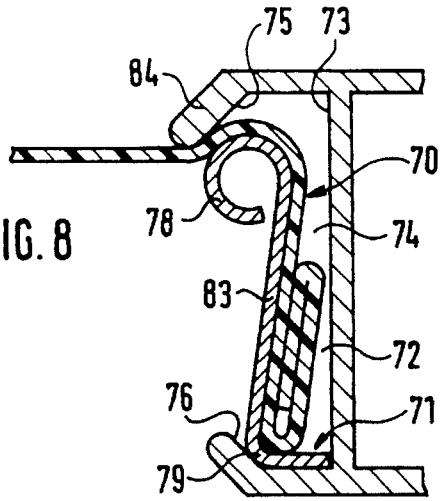

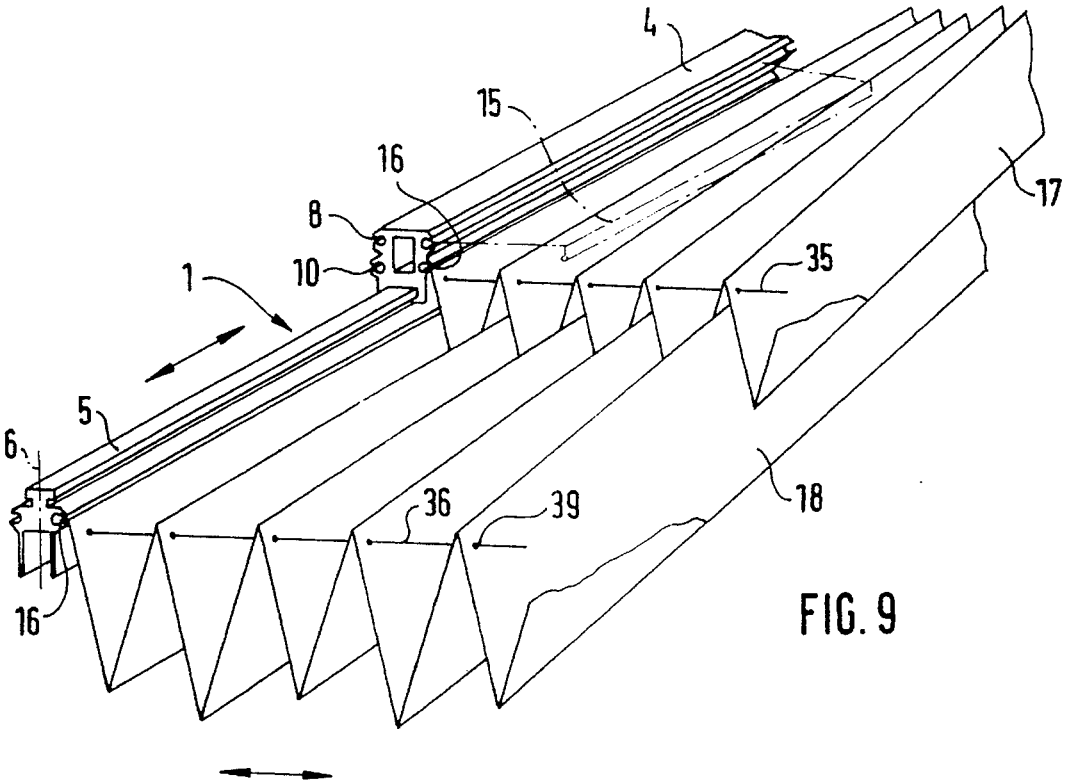
FIG. 9
FIG. 10
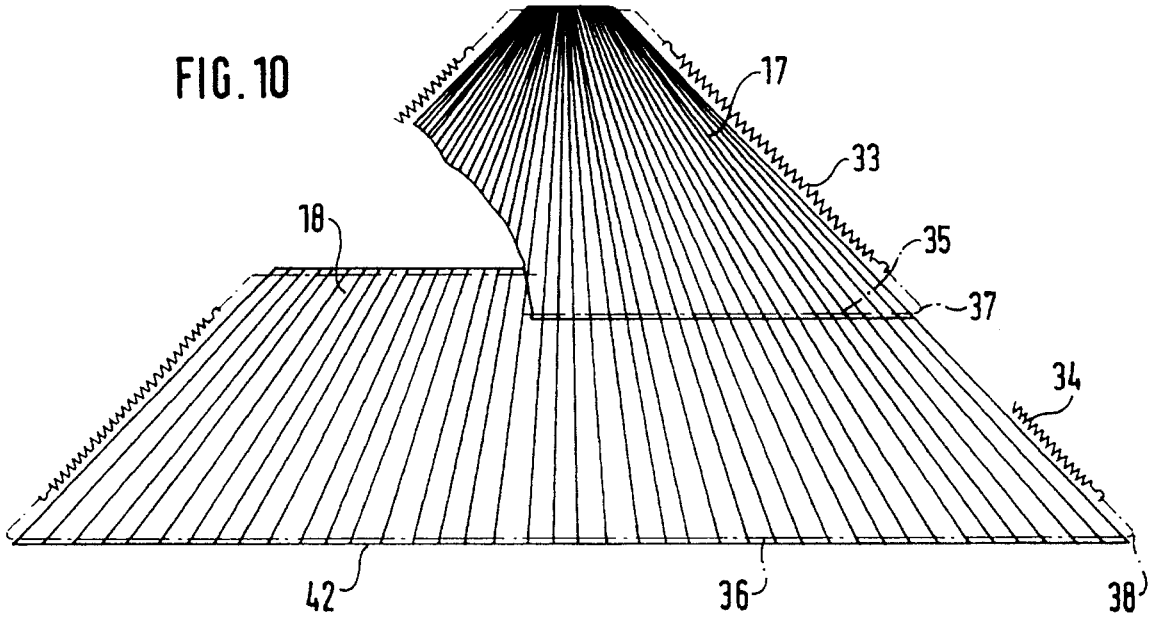

SUNSHADE

This is a divisional of application Ser. No. 07/963,055 filed Oct. 19, 1992 now U.S. Pat. No. 5,398,710.

BACKGROUND OF THE INVENTION

The invention relates to a sunshade with carrying bars pivotably fixed to a central headpiece for fixing screening surface structures and with supporting bars for supporting the carrying bars in a position spread away from the central headpiece and whose inner end is connected by means of an articulation to a sliding body, which is displaceable on a pole connected to the central body and to each of the carrying bars is fixed a different surface structure.

Known sunshades of this type suffer from the disadvantage that in the case of a large span such as is e.g. sought for restaurant gardens, in the folded up state they constitute a large structure, which can only be opened with difficulty as a result of the carrying bars which move outwards on spreading out. Tables or chairs located in the vicinity must be removed be forehand.

SUMMARY OF THE INVENTION

The problem of the invention is to provide a sunshade of the aforementioned type, which is particularly compact in the folded up or collapsed state. In addition, an embodiment is sought, which can be easily opened, without being hindered by means standing around it.

According to the invention this problem is solved in that the surface structure is made from pleated surface material, whose pleating folds are positioned radially to the central headpiece.

As a result of these features the folding together of the sunshade to form a particularly compact unit is facilitated.

A particularly esthetic, closed form is given to the compact sunshade unit in a preferred embodiment of the invention as a result of shell-like, individual envelope surfaces, provided on the carrying bars.

The compact, closed shape of the sunshade can be further improved if its pole is shortenable to such an extent that the ends of the carrying bars folded up parallel to the pole extend approximately to the ground or to a base of said sunshade.

The position of the carrying bars parallel to the pole is obtained in that, according to a further preferred embodiment of the invention, the carrying bars have a head end directed transversely inwards with respect to the bar longitudinal direction towards the central headpiece and its free end is pivotably mounted on the central headpiece of the sunshade.

BRIEF DESCRIPTION OF THE DRAWINGS

Further advantageous embodiments of a sunshade according to the invention are described in greater detail hereinafter relative to the attached drawings, wherein show:

FIG. 1 A compact, folded up form of a sunshade.

FIG. 2 The sunshade after extending its pole.

FIG. 3 The sunshade in a spreading phase.

FIG. 4 A perspective view of the sunshade according to FIGS. 1 to 3 after spreading into a use position.

FIG. 5 A larger-scale cross-section along V—V in FIG. 2.

FIG. 6 A perspective view of an area of a pleated surface structure with adjacent carrying bar.

FIG. 7 A partial cross-section through a carrying bar with an edge of a surface structure held thereon, with one position of the blocking element during installation.

FIG. 8 The partial cross-section according to FIG. 7 with a completely inserted blocking element.

FIG. 9 A perspective view of an area of two overlapping surface elements in the incompletely spread state.

FIG. 10 A perspective view of two overlapping, pleated surface structures in the spread state.

DETAILED DESCRIPTION OF THE PREFERRED EMBODIMENTS

Figures 13, 14:
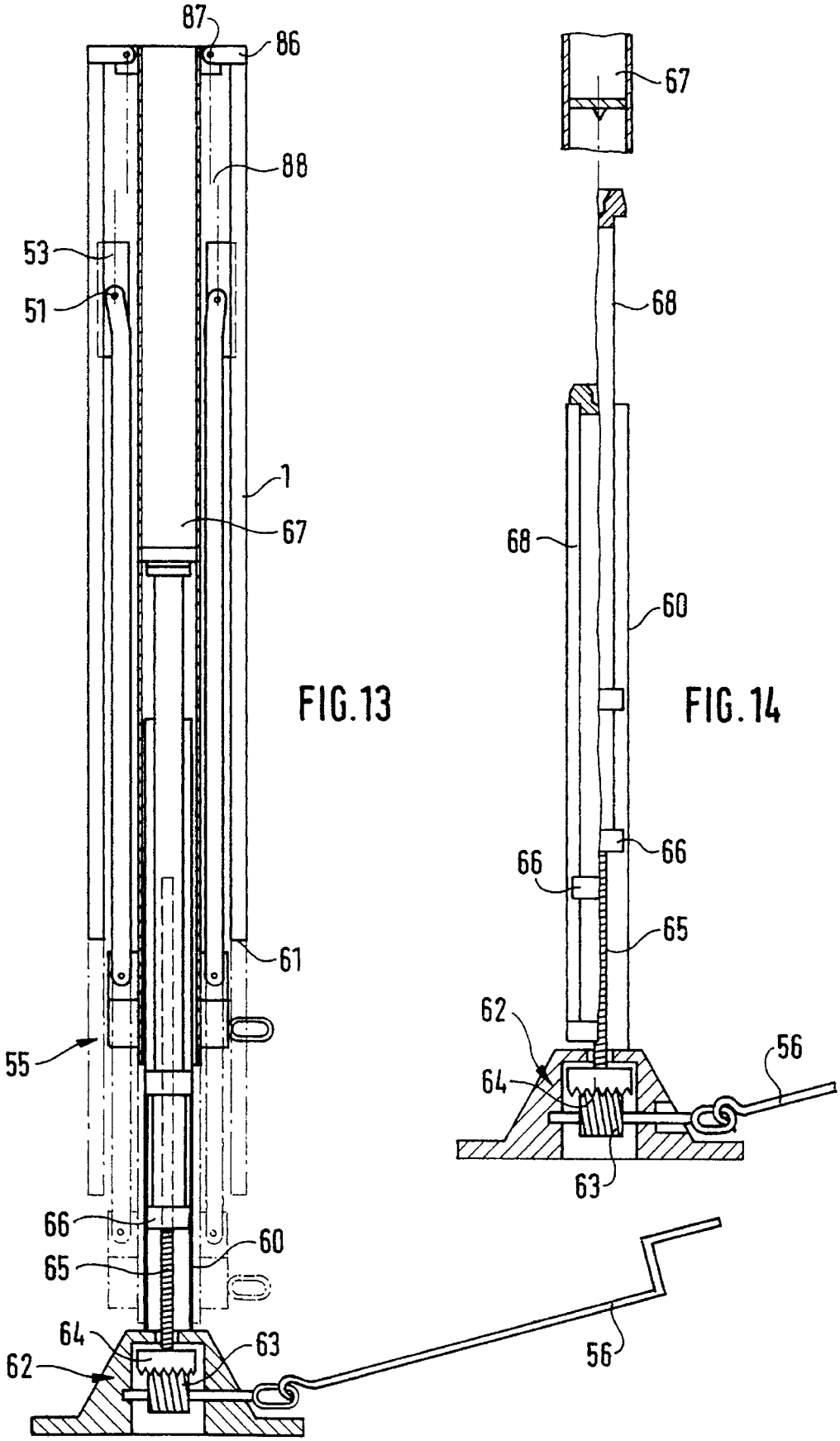
FIG. 13 A diagrammatically represented side view of the support linkage and a length-adjustable pole with two driving systems.
FIG. 14 A cross-section through the lifting device of the sunshade according to FIG. 13 with two half-represented lifting positions.
Figure 15:
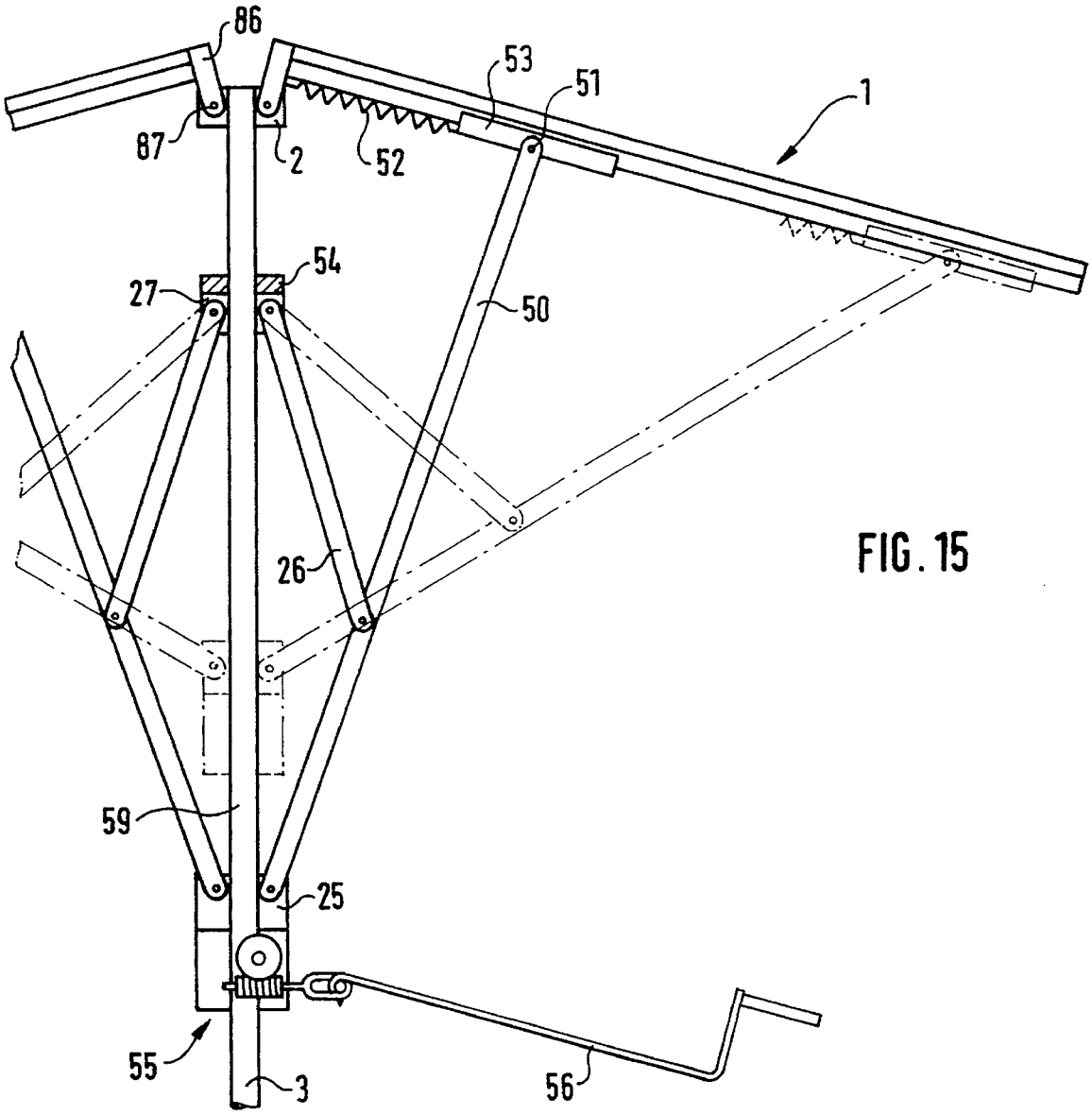
FIG. 15 A cross-section through the upper area of a sunshade in a first spreading position and with a further spreading position indicated by dot-dash dash lines.

As shown in FIG. 15, the carrying bars 1 of the sunshade, whereof there are e.g. sixteen according to a spread sunshade, extend radially outwards in a slightly inclined manner from a central headpiece 2 and are connected thereto by a uniaxial articulation or joint 87. On folding together or collapsing the sunshade a compact unit is formed with at least approximately parallel carrying bars 1, which are also parallel to the pole 3 and pivoted downwards, as illustrated by FIGS. 1, 2 and 13.

The supporting bars 50 supporting the carrying bars 1 form at the articulation 51 a support point, which moves outwards along the particular carrying bar 1 with increasing spreading or opening action. This occurs in that the articulation 51 for the supporting bar 50 is provided on a relatively short sliding element 53, which is guided on the carrying bar 1 or on a bar element 5 or 4. During the upward movement of the lower sliding body 25 the carrying bars 1 are initially pivoted upwards by the supporting bars 50. The upper sliding body 27 is then stopped on a stop member 54 fixed to the pole 3. During a further upward movement of the lower sliding body 25 the supporting bars 50 are pivoted outwards in the manner of a scissor blade, so that the sliding elements 53 are correspondingly continuously moved outwards. The resulting outwardly displaced support makes a significant contribution to the stability of the sunshade. In addition, the supporting bars 50 have a greater length than in the case of conventional sunshades, so that on collapsing the sunshade the lower sliding body 25 moves into the position shown in FIG. 13 below the lower end of the carrying bars 1.

The rearward movement of the sliding element 53 for collapsing the sunshade is facilitated by a tension spring 52, which is fixed between the head-side end 86 of the carrying bar 1 and the sliding element 53.

For a central mounting of the carrying bars 1 or the bar elements 4 on the headpiece 2 of the sunshade and as a result of which its outward pivoting is kinematically facilitated, they have a head end 86, which is directed inwards in an inclined or right-angled manner with respect to the particular bearing 87. This leads to the lateral displacement of the axes of the bearings 51 and 87 shown in FIG. 13 permitting an outward pivoting of the carrying bars 1 or the bar elements 4 by the drive 55.

There is preferably a rotary drive 55 for the upward movement of the lower sliding body 25 and it has a not shown electric motor or an elongated hand crank 56. The rotary drive 55 has a threaded worm 57, which engages in a worm gear 58. The latter either drives the pulley of a cable 59 fixed in the upper area of the pole 3 or a pinion, which engages with a rack extending along the pole 3.

In order to obtain a particularly compact structure in accordance with FIG. 1 in the completely collapsed state of the sunshade, i.e. with downwardly directed carrying bars 1, the hole is telescopically extendable, so that it can be moved upwards beyond table height prior to the spreading open with the end 61 of the telescoped carrying bars 1. There is also preferably a rotary drive 62 for this upward movement, e.g. having a driving worm 63 and a worm gear 64. The worm gear 64 drives a lifting spindle 65, which engages with a spindle nut 66, so that it can be moved upwards and downwards with the shaft 68 fixed thereto and carrying the upper pole part 67.

Therefore the sunshade can easily be spread open, although the carrying bars 1 which move outwards to a significant extent would prevent any positioning in the vicinity of the pole 3.

A sunshade according to the invention having a diameter of approximately 4 meters can, in the case of non-use, be reduced to a columnar, compact structure in accordance with FIG. 1 and whose height is approximately 2 m. Such a relatively short, columnar structure, which as a result of the outer envelope flaps 14, 15 enclosing the surface elements 17 has a closed and esthetically attractive shape, fixed well into a garden installation or the like.

The carrying bars 1 of the embodiment according to FIG. 9 have in each case a radially inner and outer bar element 4, 5 in the spread open state of the sunshade and which are displaceably guided on one another, in that they comprise interengaging profile bars.

Figure 11:
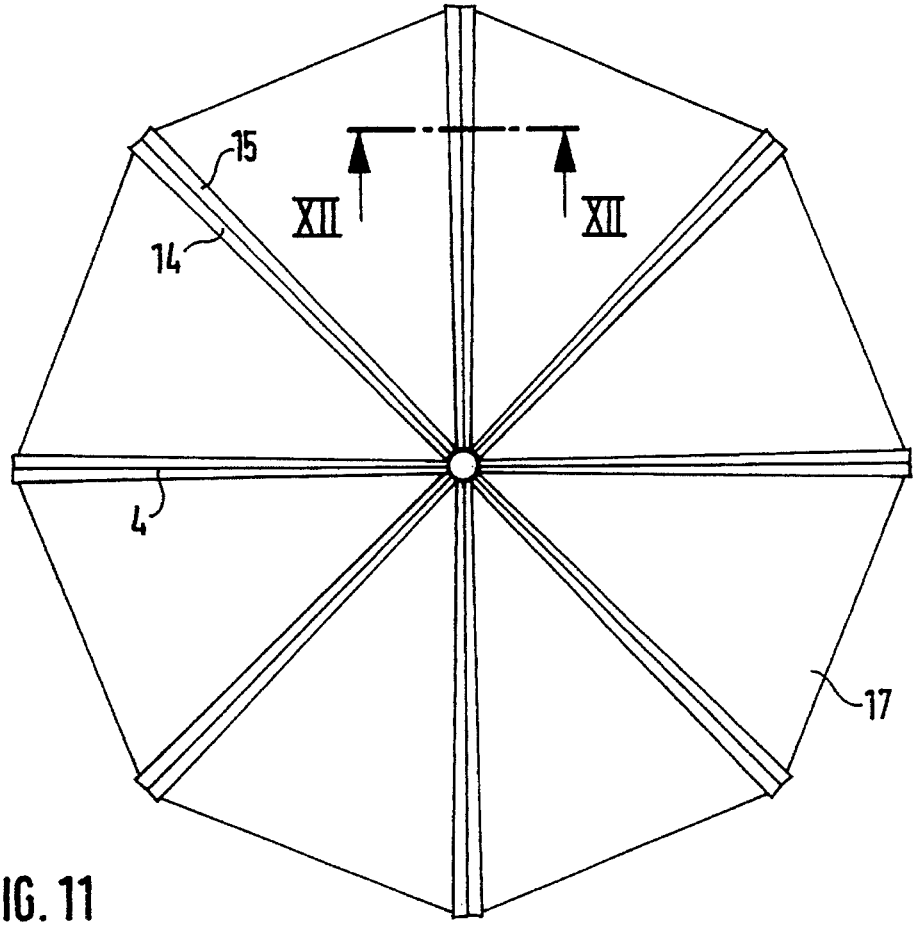
FIG. 11 A plan view of a spread sunshade with bearing envelope flaps.
Figure 12:
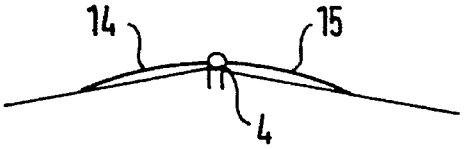
FIG. 12 A larger-scale partial cross-section along line XII—XII of FIG. 11.

For the formation of longitudinally directed reception channels 8, 10 the cross-section of the bar element 4 has on either side outwardly open, e.g. c-shaped, cross-sectional areas. The top or outer pair 8 of reception channels of the bar element 4 is used for the reception of the edge 13 of envelope flaps 14, 15, e.g. made from aluminium, which together with the other envelope flaps 14, 15 held between in each case two carrying bars 1 form a closed envelope, which lines the sunshade in the closed state in accordance with FIGS. 1, 2 and 5 and which after opening the sunshade are in engagement thereon in spaced manner. This is made clear by the plan view of a sunshade according to FIG. 11 and in particular the associated cross-sectional representation of FIG. 12.

Figure 16:
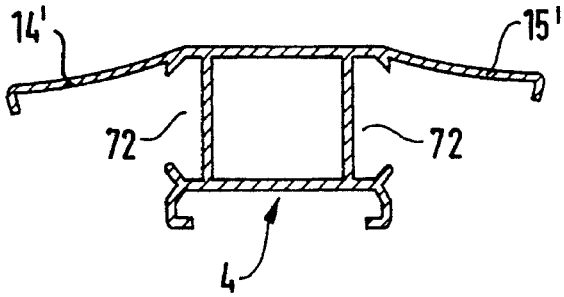
FIG. 16 A cross-section through an embodiment of the bar element with shaped on envelope profile parts.

Instead of being easily pivotably mounted in reception channels 8, the envelope surfaces 14', 15' can also be rigidly shaped in wing-like manner on either side of the bar element 4, as can be gathered from the cross-sectional representation of FIG. 16.

The reception channels 10 positioned below the reception channels 8 on the same profile bar 4 are used for receiving and retaining one edge of individual, triangular or trapezoidal, flexible surface structures 17, e.g. in the manner of a welt engagement, such as is known per se for fixing the edges of awning surfaces.

FIG. 9 illustrates the fact that as a result of the super imposed arrangement of the bar elements 4, 5, the triangular and trapezoidal surface structures 17, 18, which are adjacent in the circumferential direction of the sunshade, do not have to be sewn together to form a unitary surface structure as in the known shades and instead they have to be individually and laterally fixed to the bar elements 4, 5. A fixing according to the welt principle is suitable for this. However, this leads to the disadvantage that the edge 16 of the surface element 17, 18 must be drawn in the longitudinal direction thereof into the reception groove 10, so that it is not secured against displacement over its length and can consequently only prevent a distortion of the surface structures 17, 18 in the vicinity of its fixed ends. In addition, a sewn in welt has the disadvantage that force concentrations occur at the seams and which in the case of continuous stressing can lead to the detachment of the seam or to damage to the surface element 17, 18.

According to a preferred embodiment of the invention, in accordance with that of FIGS. 7 and 8, it is proposed to hold by at least one strip-like blocking element 71 the edge 70 of the surface structures 17, 18 which is at least double-folded e.g. by loose folding or loose rolling in, in a channel 72 of the bar element 4, 5. In said reception channel 72 in the position assumed by the blocking element 71 or as a result of the cross-sectional shape of the blocking element 71 between the latter and a channel wall 73, there is a gusset-like space 74, which encloses the at least double-folded edge of the surface structures 17, 18.

Preferably the reception channel 72 bounded at its two cross-sectional ends by undercuts 75, 76 has a maximum width, which is adequately larger than the width of the strip-like blocking element 71 to permit in a tilted position an insertion of the blocking element 71 into the channel at right angles to the longitudinal direction thereof. Therefore said width is larger at least by the amount of one of the undercuts 76, plus the thickness of the surface structures 17, 18, than the maximum width of the blocking element 71, as can be gathered from FIG. 7. This oversize of the width of the reception channel 72 compared with the width of the blocking element 71 can also be smaller. In this case the blocking element 71 is to be inserted from the channel end. However, a clear oversize permits an easy insertion, without the e.g. previously inserted edge 70 of the surface structure being displaceable in its longitudinal direction.

However, it is also possible to permit a pressing in of the strip-like blocking element 71 at right angles to the longitudinal direction of the channel 72, in that its cross-section is made resiliently deformable. The resilient deformability of the cross-section can be provided by at least one cross-sectional bend 78. In the represented embodiment there are two oppositely directed bends 78, 79 with a different radius at the cross-section ends. The surface structure 17, 18 is guided over the upper bend 78 having the larger radius, whereas the lower, oppositely directed bend 79 has a supporting function, as well as receiving the edge 70, e.g. having two folds 80, 81. The oppositely directed bends 78, 79 of the blocking element cross-section bring about the upwardly sloping path of the central cross-sectional part 83 directed towards the bar element 4, 5, so that the channel wall 73 forms the gusset-shaped space 74.

The tensile stress on the surface structures 17, 18 as a result of the spreading of the sunshade and which attempts to draw the same out of the gusset-shaped space 74, on the one hand leads to the fixing of the at least double-folded edge 70 in the gusset-shaped space 74 and on the other the fixing between the profile leg 84 forming an undercut and on the upper bend 78 of the blocking element 71. This clamping holding of the edge 70 of the surface structures 17, 18 leads to a smaller stressing of its material and therefore to a longer sunshade life. Apart from the ease of manufacture and assembly of the sunshade between a surface structure 17, 18 and a bar element 4, 5 or a carrying bar 1 it also permits an easy replacement of individual surface structures 17, 18, in order to obtain special screening effects of the already mentioned type or bring about new esthetic effects.

In order to avoid any sagging of the surface structures 17, 18 in the case of an incomplete spreading of the sunshade and in order to permit an easy closure of the sunshade to give a compact shape, the latter is made from pleated awning material or from a comparable material, which in the relaxed state and with the sunshade collapsed assumes a pointed, zig-zag cross-sectional shape in accordance with FIG. 5. In addition, cords 35, 36 connected to spring pulls 33, 34 extend in the circumferential direction of the sunshade between the carrying bars 1'. These spring pulls e.g. run along the carrying bars 1' and consequently along the lateral edges of the surface elements 17, 18, so that there are reversing points 38 in the corner areas. The connection with the surface structures 17, 18 takes place by passing the cords 35, 36 through holes or slits in the fold regions 39 thereof.

What is claimed is:

1. A sunshade with carrying bars (1) pivotably fixed to a central headpiece (2) for fixing screening surface structures (17,18) and with supporting bars (50) for supporting the carrying bars (1) in a position spread away from the central headpiece (2) and whose inner end is connected by means of an articulation to a sliding body (25), which is displaceable on a pole (3) connected to the central headpiece (2), and to each of the carrying bars (1) is fixed a different surface structure (17,18) made from pleated surface material, whose pleating folds are radial to the central headpiece (2), each surface structure (17,18) being multiply folded and being collapsible in zig-zag manner (FIG. 5) when the sunshade is closed, the sunshade further having cord spring pull assemblies (33–38) each of which comprises a cord (35,36) which extends along a path which passes between two circumferentially adjacent carrying bars (1), over a reversing point (37,38), and in the direction along the carrying bars (1), the surface structure (17,18) being displaceably guided on the cord (35,36) in the vicinity of its radially outer edge (42).

2. A sunshade with carrying bars (1) pivotably fixed to a central headpiece (2) for fixing screening surface structures (17,18) and with supporting bars (50) for supporting the carrying bars (1) in a position spread away from the central headpiece (2) and whose inner end is connected by means of an articulation to a sliding body (25), which is displaceable on a pole (3) connected to the central headpiece (2), and to each of the carrying bars (1) is fixed a different surface structure (17,18) made from pleated surface material, whose pleating folds are radial to the central headpiece (2), each surface structure (17,18) being multiply folded and being collapsible in zig-zag manner (FIG. 5) when the sunshade is closed, wherein the lower area (60) of the pole has two telescopically guided pole elements (60,68), one of the pole elements (60) being designed for fixing in the ground or to a base, and the other pole element (68) being connected to a lifting device (65) having a rotary drive (62) provided with an elongated, detachable hand crank (56).

3. A sunshade with carrying bars (1) pivotably fixed to a central headpiece (2) for fixing screening surface structures (17,18) and with supporting bars (50) for supporting the carrying bars (1) in a position spread away from the central headpiece (2) and whose inner end is connected by means of an articulation to a sliding body (25), which is displaceable on a pole (3) connected to the central headpiece (2), and to each of the carrying bars (1) is fixed a different surface structure (17,18) made from pleated surface material, whose pleating folds are radial to the central headpiece (2), each surface structure (17,18) being multiply folded and being collapsible in zig-zag manner (FIG. 5) when the sunshade is closed, wherein the lower area (60) of the pole has two telescopically guided pole elements (60,68), one of the pole elements (60) being designed for fixing in the ground or to a base, and the other pole element (68) being connected to a lifting device (65) having a rotary drive (62) provided with an electric motor positioned on a base of the sunshade.

* * * * *